United States Patent [19]

Lalezari

[11] Patent Number: 4,816,836

[45] Date of Patent: Mar. 28, 1989

[54] CONFORMAL ANTENNA AND METHOD

[75] Inventor: Farzin Lalezari, Louisville, Colo.

[73] Assignee: Ball Corporation, Muncie, Ind.

[21] Appl. No.: 823,702

[22] Filed: Jan. 29, 1986

[51] Int. Cl.[4] ..... H01Q 1/38

[52] U.S. Cl. ..... 343/700 MS; 343/873; 29/846; 29/847; 156/215

[58] Field of Search ..... 343/700 MS, 795, 705, 343/829, 846, 873, 708; 29/846, 825, 847; 361/398; 156/212, 215, 150

[56] References Cited

U.S. PATENT DOCUMENTS

| | | | |
|---|---|---|---|
| 3,005,986 | 10/1961 | Reed | 343/708 |
| 3,013,919 | 12/1961 | Bialy | 156/212 |
| 3,577,196 | 5/1971 | Pereda | 343/770 |
| 4,110,751 | 8/1978 | Reggia et al. | 343/700 MS |
| 4,605,932 | 8/1986 | Butscher et al. | 343/708 |

FOREIGN PATENT DOCUMENTS

| | | | |
|---|---|---|---|
| 221007 | 12/1984 | Japan | 343/700 MS |
| 2131232 | 6/1984 | United Kingdom | 343/700 MS |

OTHER PUBLICATIONS

"Photofabrication of Printed Circuits", Eastman Kodak Company Publication No. P-125, Rochester, N.Y., 1968, pp. 25, 26.

Balanis, "Antenna Theory Analysis and Design", Harper & Row, Publishers, New York, 1982, pp. 490 and 495.

*Primary Examiner*—William L. Sikes
*Assistant Examiner*—Michael C. Wimer
*Attorney, Agent, or Firm*—Gilbert E. Alberding

[57] ABSTRACT

An antenna assembly and a method for mounting an antenna element in full conformity to a substantially curved surface are disclosed. The method includes the steps of providing a first, relatively thin dielectric substrate portion having an antenna element formed on a surface thereof; providing a second, relatively thick dielectric substrate portion; shaping and securing the second substrate portion to the curved surface; and shaping and securing the first substrate portion and the antenna element to the second substrate portion. The method permits a microstrip antenna, or other thin structure supported on a substrate, to be mounted to curved surfaces of even short radius or curvature (e.g., less than four inches) in full conformity therewith without damaging the thin fragile antenna element.

10 Claims, 1 Drawing Sheet

CONFORMAL ANTENNA AND METHOD

BACKGROUND OF THE INVENTION

The present invention relates generally to conformal antennas and, in particular, to conformal microstrip antennas and to methods for mounting such antennas to surfaces with small radii of curvature for reliable operation.

The microstrip antenna, including its radiator and transmission line feed, is a well-known structure. In its simplest form, the microstrip radiator patch may simply be a square or rectangular metal conductor fed at one of its edges by an integral microstrip transmission line. This shaped transmission line/radiator structure is typically supported a short distance above a ground plane by a dielectric sheet or layer having a thickness substantially less than one-fourth wavelength at the intended operating frequency of the antenna (e.g., generally on the order of one-tenth wavelength or less). The resonant dimension of the radiator patch is typically chosen to be one-half wavelength, thus providing a pair of radiating slots between opposed edges (e.g., transverse to the feedline) and the underlying ground plane. The transverse or non-resonant dimension of the radiator is typically chosen, at least in part, as a function of the desired relative radiated power. If the non-resonant dimension is on the order of one wavelength or more, multiple feed points are generally provided (e.g., via a corporate-structure feed network). Such microstrip radiators may also be arrayed with corporate or other structures of microstrip feedlines integrally formed and connected therewith.

Conventional microstrip antenna structures are conveniently formed by photochemical-etching processes similar to those used in the manufacture of printed circuit boards. A microstrip antenna assembly is formed, typically, from flat printed circuit board material, that is a dielectric sheet material with a thin layer of conductive metal, such as copper, being adherent on both sides of dielectric sheet material. One conductive layer typically forms the ground plane or reference surface, and conductive metal is removed from the other layer by chemical etching to form the very thin microstrip radiator and interconnected transmission line structure as shaped conductive metal patches on the resulting dielectric sheet. The thickness of the entire antenna assembly, consisting of the dielectric sheet and the thin, conductive, metal layers, is on the order of one-thirty second (1/32) of an inch to two-tenths (2/10) of an inch. The thickness of the etched radiator and transmission line structure is commonly on the order of about 1.4 mils.

In microstrip antennas, the thickness of the dielectric sheet between the ground plane and the metal patches that act as the antenna radiators is selected based upon the bandwidth over which the antenna must operate. The bandwidth of microstrip antennas is proportional to the thickness of the dielectric substrate, as indicated by the following formula:

$$BW = 4f^2(t/1/32)$$

where BW is the in megahertz for VSWR $<$2:1, f is the frequency in gigahertz, and t is the board thickness in inches. Since the substrates are generally very thin in terms of the wavelengths (i.e., very much smaller than $\frac{1}{4}$ wavelength), the bandwidth is usually narrow. The efficiency of the microstrip antenna is also affected by the thickness of the dielectric substrate. With thickness that is too small, the conductance across the dielectric yields excessive dielectric losses. Because of their contribution to antenna power loss, lossy dielectrics, such as epoxy fiberglass, are frequently avoided in microstrip antennas. The exact value of t has been generally determined by the commercially available printed circuit board thicknesses available from suppliers. Preferred materials include expensive Teflon-fiberglass boards of the type available from 3M, Rogers Corporation, Keene Corporation, and the like.

A desirable characteristic of microstrip antennas is their capability of being conformed to and mounted upon the curved surfaces. Because microstrip antennas may be conformed to curved surfaces, and provide a low profile (which reduces turbulence effects), and because microstrip antennas are able to withstand shock and vibration, they are often mounted on external; curved surfaces of airplanes, missiles, instrumented artillery shells, and other aircraft and projectile systems. Typically, mounting is accomplished by initially fabricating the antenna assembly as a flat sheet of dielectric material having microstrip radiation and transmission line elements formed on or otherwise adhered to one surface, and a ground plane adhered to the opposite surface. The assembly as a whole is then deformed or bent to conform to the curved surface on which the assembly is to be mounted and then secured to the surface.

Generally, the mounting surface is of convex shape; and the antenna assembly is deformed so that the microstrip antenna element will be on the outer convex surface thereof when the assembly is mounted to the surface. The concave surface of the deformed assembly is generally bonded to the mounting surface.

The above-described mounting procedure has not, however, proven to be fully satisfactory. As the microstrip antenna assembly is bent about small radii, the outer convex surface is placed under a substantial tension and must stretch, causing adjacent areas thereon to pull apart from one another. The stretching forces are transmitted to the antenna elements on the surface, tending to pull the antenna elements apart. Because of the thinness and fragile nature of the antenna (it is usually formed of relatively soft copper), the stretching forces can cause the antenna element to crack and can result in breaks in the conductive antenna elements, greatly reducing the effectiveness of the antenna structure. In addition, the stretching forces can cause loss of adherence between the antenna elements and the substrate, resulting in their separation from the underlying dielectric sheet. These unadhered antenna elements cannot reliably withstand the tremendous aerodynamic forces imposed on them by the projectile or aircraft upon which the antenna element is mounted as it moves through the air at high speed, and the unadherent antenna element can be torn away from the dielectric sheet and the microstrip antenna will be destroyed.

The exposure of a conformal microstrip antenna to such damage increases as the radius of curvature of the mounting surface decreases and as the thickness of the dielectric antenna substrate increases; and with the prior mounting techniques, it has been difficult to conform an antenna assembly onto a curved surface having a radius of curvature of less than about four inches without significant danger of substantial damage to the antenna element.

SUMMARY OF THE INVENTION

The present invention provides a method for reliably mounting a conformal microstrip antenna onto a curved surface with a small radii of curvature. Such a method comprises the steps of providing at least one conductive antenna element on a very thin dielectric substrate portion; providing a second dielectric substrate portion having a second thickness substantially greater than a very thin first dielectric substrate; shaping and securing said second dielectric substrate portion to the curved surface in full conformity therewith; and securing the very thin first dielectric substrate portion and the conductive antenna element affixed thereto to said second substrate portion.

In a presently preferred embodiment of the invention, the dielectric substrate of a microstrip antenna assembly is thus formed in two portions: a relatively thick portion which is initially shaped and secured to the curved surface and a relatively very thin portion upon which an antenna element is affixed and which is thereafter shaped and secured to the relatively thick portion. Because the antenna element is affixed to a very thin substrate, the thin substrate portion can be easily bent to even a very short radius of curvature without causing the antenna element to break or lose its adherence to the substrate and become damaged.

In the presently preferred embodiment, the thin element comprises a microstrip antenna element affixed to a dielectric substrate, which is particularly adapted to be mounted on and conformed to a curved surface such as an external, sharply curved surface of a missile, aircraft, or the like. The first substrate portion preferably comprises a film having a thickness of about two to about five thousandths of an inch, and the second substrate portion preferably comprises a sheet having a thickness of about one-thirty second (1/32) of an inch to about two tenths (2/10) of an inch. In general, it is preferred that the thickness of the second substrate portion be at least about fifty times greater than that of the first substrate portion. The microstrip antenna circuit is preferably photochemically etched onto the very thin first substrate portion and has a thickness of about 1.4 mils.

The first substrate portion is preferably bonded to the second substrate portion by application of heat and is, thus, made integral with the second substrate portion.

The first substrate portion can be bonded to the second substrate portion with the antenna element on the outside surface, or with the antenna element on the inside surface that is bonded to the second substrate. In the latter embodiment, the thin substrate portion functions as a radome to help protect the antenna element against exposure to aerodynamic forces, high temperatures and the like.

If desired, the first substrate portion can be bonded to the second substrate portion simultaneously as the second substrate portion is being secured to the curved surface.

With the present invention, a microstrip antenna can be reliably mounted to curved surfaces of cylindrical, conical, or other curved surfaces with short radius of curvature, quickly, inexpensively, and with a reduced likelihood of damage to the microstrip antenna element.

Further advantages and specific features of the invention will be set forth hereinafter in the following detailed description of the preferred embodiment taken in conjunction with the drawings.

BRIEF DESCRIPTION OF THE DRAWINGS

FIG. 4 illustrates a curved surface on which the antenna is to be mounted; FIG. 5 illustrates the surface of FIG. 4 having the second substrate portion secured thereto; and FIG. 6 illustrates the complete antenna assembly mounted to the curved surface of FIG. 4.

DETAILED DESCRIPTION OF THE PREFERRED EMBODIMENTS

Figure 1A:
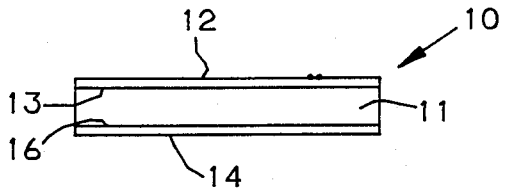
FIG. 1A PRIOR ART
FIGS. 1A and 1B schematically illustrate the prior method for mounting a microstrip antenna element to a curved surface in conformity therewith.
Figure 1B:
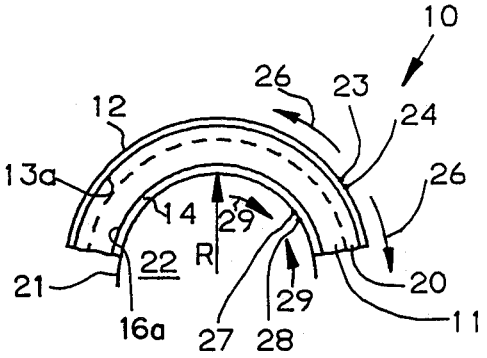
FIG. 1B PRIOR ART

FIGS. 1A and 1B schematically illustrate the prior method for mounting a microstrip antenna to a curved surface to help explain the present invention. Initially, a flat antenna assembly 10 is fabricated as illustrated in FIG. 1A. Antenna assembly 10 comprises a dielectric sheet or substrate 11 having microstrip antenna element 12 adherent to one surface 13 thereof. Generally, a grounding plane or plate 14 is also adherent to the opposite surface 16 of the dielectric sheet.

Substrate 11 is composed of dielectric material that is capable of being bent or deformed into a curved configuration and is preferably composed of polytetrafluoroethylene and fiberglass. The microstrip antenna element 12 and ground plane 14 can be affixed to surfaces 13 and 16, respectively, of dielectric sheet 11 in any appropriate manner, but preferably are adhered by the processes used in the manufacture of printed circuit boards. In such processes, a very thin layer of a conductive metal such as copper is clad onto both surfaces 13 and 16 of sheet 11. In forming a microstrip antenna, one clad side forms ground plane 14, and the other side is then photochemically etched into the shaped conducting elements which define the microstrip radiators and interconnected transmission line of the antenna.

The antenna element 12 can be formed as defined by antenna theory. In its simplest form, such an element may consist of a metal radiator patch of square or rectangular shape fed at one of its edges by an integral microstrip transmission line. The antenna element 12 may also take the form illustrated in FIG. 3 and may comprise a plurality of rectangular metal patches 17 interconnected by integral transmission lines 18.

The entire antenna assembly 10, fabricated as illustrated in FIG. 1A, is then deformed or bent as shown in FIG. 1B to conform to a curved surface 21 on an object 22 onto which the antenna structure is to be placed and then secured to surface 21. Object 22 can comprise a missile, an instrumented artillery shell or other projectile adapted to be driven at high speed through the air, an airplane or other aircraft, or any other object upon which it may be desirable to mount a microstrip antenna. Assembly 10 can be fastened or bonded to the object surface 21 by any suitable fasteners or a bonding medium such as epoxy or the like. The antenna element 12 will be on the outside convex surface 13*a* of the shaped assembly 10; and the ground plane 14 will be on the inner surface 16*a* that is bonded to surface 21.

This prior method for mounting a microstrip antenna to a curved surface has not proven to be satisfactory. Specifically, as shown in FIG. 1B, when antenna assembly 10 is conformed to convex curved surface 21, surface 13*a* thereof will assume a convex shape; and surface 16*a* thereof will assume a concave shape. Convex surface 13*a* of substrate 11 will be stretched, tending to pull apart adjacent areas on the surface 13*a;* e.g., areas 23 and 24 tend to move away from one another as indicated by arrows 26. Similarly, concave surface 16*a* will be placed under compression, tending to push adjacent areas on surface 16*a* closer together, e.g., areas 27 and 28, closer together, as indicated by arrows 29.

Although the dielectric sheet 11 is sufficiently flexible to be bent and deformed without being damaged, the very thin and fragile copper antenna element 12 frequently cannot withstand any significant stretching forces without being damaged. If antenna element 12 is rigidly affixed to surface 13*a,* antenna element 12 will be stretched as surface 13*a* is stretched. The antenna element 12 can easily develop cracks when the assembly 10 is bent to conform it to a curved surface 21, causing breaks to occur in the conductive paths defined by the element. If the antenna element 12 is not securely adherent to surface 13*a,* the stretching forces can cause portions such as the edges of the antenna element 12 to separate or pop up from the dielectric sheet 11. This is unacceptable because of the very substantial aerodynamic forces encountered by the unadherent antenna element as a missile or other object upon which it is mounted moves rapidly through the air. Such forces can cause the antenna element to be completely ripped away from the antenna. In addition, antenna elements are frequently fed by coaxial connections through holes in the dielectric substrate by soldering a coaxial cable conductor passing axially through a hole in the dielectric to the antenna element from its underside. Such connections have been frequent causes of unreliability and become even more unreliable where the microstrip antenna is conformed to small radii of curvature.

It should be apparent from FIG. 1B that the relative degree to which the outer surface 13*a* and antenna element 12 will be stretched to conform to a mounting surface will increase as the radius of curvature R of surface 21 decreases. In particular, for a curved surface 21 having a very large radius of curvature, only a relatively slight amount of bending of assembly 10 is required to conform it to surface 21; and surfaces 13*a* and 16*a* of substrate 11 will be subjected to relatively small amounts of stress. For surfaces 21 having a small radius of curvature, however, the degree of bending required to conform the assembly 10 to surface 21 will be substantial; and the stretching force imparted to surfaces 13*a* and 16*a* and to antenna element 12 will be substantial. When practicing the mounting method illustrated in FIGS. 1A and 1B, it is difficult to conform an antenna assembly to a surface having a radius of curvature of less than about four inches without substantial risk of damage to the antenna element 12. The extent to which the surfaces 13*a* and 16*a* of substrate 11 are stretched or compressed, respectively, is also greater with thicker sheets. Along some intermediate plane illustrated by dotted line at 20 in FIG. 1B, there will be substantially no stretching or compression forces within the substrate 11. However, with practical microstrip antennas, the substrate thickness needed to provide a satisfactory bandwidth is large enough to create sufficient forces on the antenna elements of the surfaces of the substrate, or at the interface between the antenna elements and the substrate, that conformal microstrip antennas cannot be reliably mounted on curved surfaces having a radius of curvature of less than about four inches without damaging the antenna element.

Figure 2:
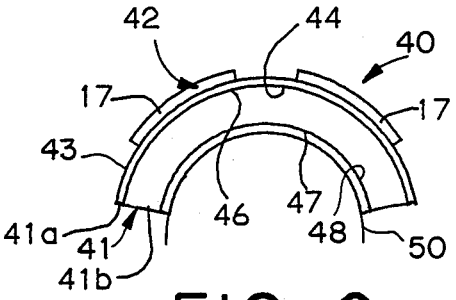
FIG. 2 schematically illustrates a microstrip antenna assembly according to a presently preferred embodiment of the invention, with the thin elements drawn substantially out of scale so they may be shown and described.
Figure 4:
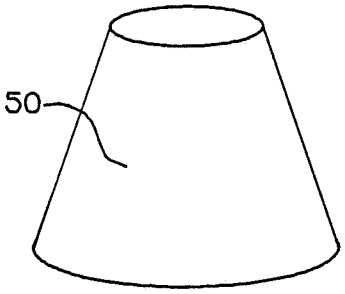
FIGS. 4–6 illustrate a method for mounting a microstrip antenna to a curved surface according to a presently preferred embodiment of the invention. Specifically.
Figure 5:
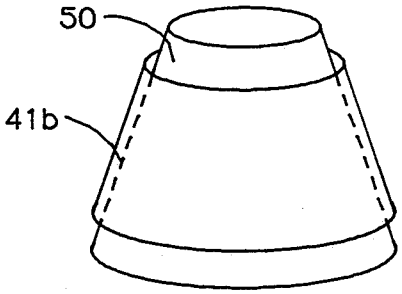
Figure 6:
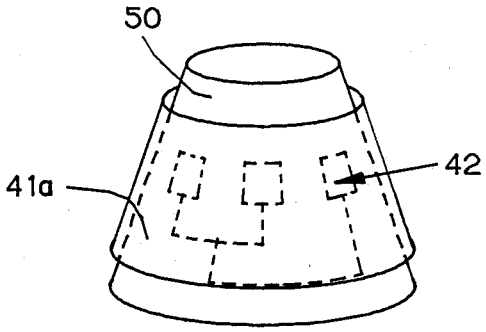

In the present invention, a method for mounting a microstrip antenna to a curved surface is provided which enables the antenna to be precisely conformed to surfaces of even short radius of curvature with substantially reduced risk of damage to the thin, fragile antenna element. The method according to a presently preferred embodiment of the invention is illustrated in FIGS. 4–6. An antenna assembly 40 provided by such a method is illustrated in FIG. 2. Antenna assembly 40 differs from antenna assembly 10 primarily in that it includes a substrate 41 which comprises a first substrate portion 41*a* and a second substrate portion 41*b*. Substrate portions 41*a* and 41*b* can preferably be formed of the same material; for example, polytetrafluoroethylene and fiberglass.

Portion 41*a* is much thinner than portion 41*b*. In a preferred embodiment, for example, second substrate portion 41*b* has a thickness of about 1/32 of an inch to about 2/10 of an inch, a dielectric constant between about one to about twenty, and a thickness substantially less than one-quarter wavelength at the intended operating frequency of the antenna. Substrate portion 41*a* has a thickness of about two thousandths of an inch to about five thousandths of an inch and a thickness on the order of 0.01 wavelength. Preferably, substrate portion 41*b* is at least about fifty times as thick as substrate portion 41*a*.

Figure 3:
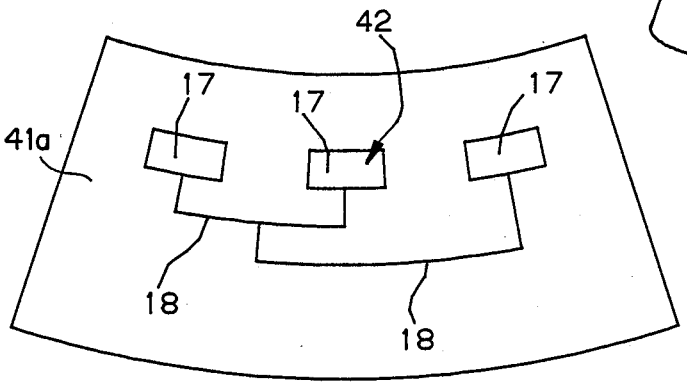
FIG. 3 schematically illustrates the first substrate portion of FIG. 2 with an antenna element affixed thereto.

As shown in FIG. 2, the desired antenna circuit 42 is formed upon surface 43 of substrate portion 41*a* by photochemical-etching processes, as described above. Typically, the antenna element 42 will have an thickness of about 1.4 mils on the surface 43 of the substrate portion 41*a* and be formed in relief on surface 43 by the etching process. A suitable antenna circuit 42 is illustrated in FIG. 3 and includes rectangular metal radiator patches 17 joined together by integral transmission lines 18. It should be understood that circuit 42 in FIG. 3 is exemplary only and may take many other forms.

If desired, a ground plane 47 may be clad onto surface 48 of substrate portion 41*b,* as shown in FIG. 2.

FIG. 4 illustrates a curved surface 50 to which antenna assembly 40 is to be mounted. Surface 50 is illustrated as being of generally conical shape although surface 50 can also be of cylindrical or other curved non-flat configuration. As a first step in practicing the method of the present invention, substrate portion 41*b,* with an adherent ground plane 47, if desired, is shaped and secured to surface 50, as shown in FIG. 5. Portion 41*b* is relatively thick and the opposed surfaces thereof are subjected to substantial stretching and compression forces; however, the antenna element 42 is not mounted to portion 41*b* and, therefore, is not subjected to risk of damage when portion 41*b* is deformed and mounted. Substrate portion 41*b* can be mounted to surface 50 by epoxy or another suitable bonding medium.

The substrate portion 41*a,* having the antenna 42 formed thereon, is then shaped and secured to substrate portion 41*b*. Because substrate portion 41*a* is extremely thin, the surfaces 43 and 44 thereof will not be subjected to any significant stretching or compression forces when the portion 41*a* is sharply bent to conform to small radii of curvature; and accordingly, the antenna element 42 will also not be subjected to any significant stretching force tending to pull the element apart. Substrate portion 41*a* is preferably bonded to substrate portion 41*b* by the application of heat and is thereby made integral with substrate portion 41*b* to provide a unitary antenna assembly 40 mounted and conformed to surface 50, as shown in FIG. 2.

Thus, with the present invention, a microstrip antenna element can be conformed and mounted on to a curved surface of even short radius of curvature, for example, less than four inches, with substantially reduced risk of damaging the antenna element. The mounting method is relatively simple and straightforward and does not significantly add to the cost of fabricating the antenna.

The antenna assembly of the present invention also provides substantial flexibility in design. For example, the antenna can be assembled with the antenna 42 affixed to the outer surface 43 of substrate portion 41*a*, as shown in FIG. 2. Alternatively, the antenna can be assembled with the antenna element as part of the inner surface 44 and bonded directly to outer surface 46 of substrate portion 41*b*, resulting in the antenna being sandwiched between substrate portions 41*a* and 41*b*. In this embodiment, substrate portion 41*a* functions as a radome to help protect the antenna element against extraneous forces, excessive temperatures, and the like.

FIG. 6 shows the antenna element 42 in dotted line to illustrate the embodiment in which the antenna element is sandwiched between substrate portions 41*a* and 41*b*.

While what has been described constitutes a presently preferred embodiment of the invention, it should be recognized that the invention can take various other forms. For example, it is not intended to restrict the invention to antennas and their fabrication and mounting, as the invention can be used to mount other assemblies comprising thin structures affixed to a substrate to a curved surface. For example, the invention can be employed to mount printed circuit boards of various types to a curved or other non-linear surface. Further, the range of components that may be conformed in accordance with the subject invention includes varied shaped radiating elements, feed networks, phasing networks, active and/or passive semiconductor devices, digital logic interface circuits, microcomputer controllers, and the like.

Although the invention is particularly useful to protect antenna elements that have been formed by photochemically etching them on printed circuit board materials, the invention is useful where antenna elements may be mounted to, formed on or otherwise adhered to a surface of substrate portion 41*a* in other ways. In addition, the antenna elements may be formed on the outer surfaces of honeycomb materials to provide an air dielectric portion between the conductive antenna elements and the ground plane.

Because the invention can take other forms, it should be understood that the invention should be limited only insofar as is required by the scope of the following claims.

I claim:

1. A method of mounting an electrical circuit element, comprising a thin, electrically conductive, planar antenna structure clad onto and interfaced with a dielectric substrate, in full conformity with a curved article surface having a radius of curvature of about four inches or less, said method comprising:

providing the planar antenna structure on a first dielectric substrate portion having a thickness of about 2 thousandths to about 5 thousandths of an inch;

shaping a second dielectric substrate portion having a thickness of at least about 1/32 of an inch to conform to said curved article surface;

securing to said curved article surface by the application of a suitable bonding material said second dielectric substrate portion conforming to said curved article surface to provide a dielectric spacer and outer surface thereon; and after shaping and in mounting said second dielectric substrate portion to said curved article surface, shaping and bonding the first substrate portion to the outer dielectric surface of said second substrate portion to form said circuit element with said planar antenna structure in full conformity with the curved article surface.

2. A method of claim 1 wherein the electrically conductive, planar antenna element is photoetched on a surface of said first substrate portion and has a thickness of about 1.4 mils.

3. A method of claim 1 wherein the first substrate portion is bonded to the second substrate portion by the application of heat and is made integral with said second substrate portion.

4. A method of claim 1 wherein the second substrate portion is provided with a conductive ground plane on a surface thereof.

5. A method of claim 1 wherein the first substrate portion is interfaced with and bonded directly to the outer surface of said second substrate portion to seal said antenna element between said first and second substrate portions to define a radome.

6. A method of claim 1 wherein the second substrate portion has a thickness of about 1/32 to about 2/10 of an inch.

7. A method of claim 1 wherein the antenna element comprises substantially copper.

8. A method of claim 1 wherein the dielectric constant of the second substrate portion is between about one to about twenty and said second substrate portion has a thickness substantially less than one-quarter wavelength at the intended operating frequency of the antenna structure.

9. A method of claim 7 wherein the thickness of the first substrate portion is on the order of 0.01 wavelength at the intended operating frequency of the antenna structure.

10. A method of claim 1 wherein said first and second substrate portions comprise fiberglass and polytetrafluoroethylene.

* * * * *